US011636784B2

(12) United States Patent
Umhoefer

(10) Patent No.: US 11,636,784 B2
(45) Date of Patent: Apr. 25, 2023

(54) SYSTEMS AND METHODS RELATED TO ARRANGEMENT OF TILES

(71) Applicant: GTU Enterprises LLC, Milwaukee, WI (US)

(72) Inventor: Gregory T. Umhoefer, Milwaukee, WI (US)

( * ) Notice: Subject to any disclaimer, the term of this patent is extended or adjusted under 35 U.S.C. 154(b) by 0 days.

(21) Appl. No.: 17/062,012

(22) Filed: Oct. 2, 2020

(65) Prior Publication Data

US 2022/0108634 A1 Apr. 7, 2022

(51) Int. Cl.
*G09F 7/18* (2006.01)

(52) U.S. Cl.
CPC ..... *G09F 7/18* (2013.01); *G09F 2007/1847* (2013.01)

(58) Field of Classification Search
CPC ..... A47G 1/065; A47G 29/08; G09F 7/18; G09F 2007/1847; Y10T 24/44026
See application file for complete search history.

(56) References Cited

U.S. PATENT DOCUMENTS 1,407,177 A * 2/1922 Stone ..... A47G 1/215 248/490
3,471,959 A * 10/1969 Seger ..... G09F 15/0006 40/731
3,965,583 A * 6/1976 Price ..... A47F 7/163 434/75
4,017,989 A * 4/1977 Murray ..... A47G 1/065 40/731
4,689,906 A * 9/1987 Sherman ..... A47G 1/0605 248/495
5,761,839 A * 6/1998 Heikkila ..... G09F 7/08 40/730
6,054,968 A * 4/2000 De Matteo ..... G09F 15/0068 312/7.2
7,059,482 B2 * 6/2006 Reid ..... A47F 7/163 211/118
9,254,051 B2 * 2/2016 McPhillips ..... G09F 15/00
9,532,670 B2 * 1/2017 Vaessen ..... A47G 1/1606
10,788,067 B2 * 9/2020 Ninaber ..... B44C 1/28

FOREIGN PATENT DOCUMENTS

DE 3833608 A1 * 12/1989 ..... A47G 1/215
WO WO-2016044904 A1 * 3/2016 ..... A47G 1/17

* cited by examiner

*Primary Examiner* — Cassandra Davis

(57) ABSTRACT

A system, method, and kit facilitate the arrangement of tiles comprising a plurality of tiles coupled together and mounted to a mounting surface using a plurality of hangers and fasteners. The tiles, whether individually or when arranged together, are preferably decorative or aesthetically pleasing. Each tile may form a portion of an overall larger visual image, which may be formed by a concatenation of a plurality of the tiles. The system, method, and kit for creating arrangement of tiles may be used to create large-scale artwork from the plurality of tiles, where the various tiles may be removably arranged and may be reconfigured or deconstructed.

15 Claims, 6 Drawing Sheets

SYSTEMS AND METHODS RELATED TO ARRANGEMENT OF TILES

BACKGROUND OF THE INVENTION

Framed photographs, canvases, and paintings, and other artwork are commonly displayed in a home or office for the aesthetic value they provide. Rather than keep a wall bare, it is typical to hang one or more pieces of art to make a room more pleasing to the eye. Despite its popularity, the display of hanging artwork can be an expensive and risky proposition: (1) art often bears an excessively high purchase price; (2) it is expensive, risky, and cumbersome to transport from one location to another; (3) it is difficult to display safely without damaging the art or the wall on which it hangs; (4) art may be suited for one space but not another; and (5) the owner's needs or tastes can change over time, which means that a single piece of art may only serve its purpose for a finite period of time. Each of these factors is even more likely to be true when the artwork in question is large in dimension. When one wishes to hang a large piece of art in a home or office, traditional artwork may make the proposition unfeasible for one or more of the reasons listed above.

Prior devices attempt to allow an individual to create large artwork by joining together smaller wall decorations using a series of connecting elements. For example, see U.S. Pat. No. 9,532,670. While this prior device takes a step towards solving problems associated with transporting large pieces of art, it fails to remedy most. For example, the prior device fails to account for simplification of relocation, reconfiguration, or deconstruction of artwork. Moreover, it complicates a mounting/hanging process.

Therefore, there exists a need for artwork that aims to be inexpensive to transport, easy to hang, easy to construct, and able to be reconfigured or deconstructed to suit a variety of an individual's tastes and spaces as both change. The invention described herein cures at least some of the deficiencies of prior devices and solves at least some and preferably all of the problems identified above by creating an arrangement of tiles that is easy to transport, is easy to construct, can be configured in a variety of ways, can be reconfigured or deconstructed without damage to the artwork, and can be easily hung on a wall without risk to the artwork or the surface on which the art hangs.

SUMMARY OF THE INVENTION

According to an embodiment of a system according to the present invention, the system (which may be provided as a kit in a single package) includes at least one hanger having a plurality of clips (e.g., four clips), wherein each clip includes a clip body and a clip prong. The system also includes at least one tile, but preferably a plurality of tiles, wherein each tile preferably has a tile aperture with a tile aperture diameter. A first plurality of tiles may be removably couplable to a hanger by inserting a first clip into a tile aperture on a first tile and a second clip into a tile aperture on a second tile, which may cause the the clip body and tile aperture to be concentric.

According to another aspect of an embodiment of a system according to the present invention, the clip body may include a clip aperture extending through the entirety of the clip body.

According to still another aspect of an embodiment of a system according to the present invention, the hanger may include one or more score lines or grooves to facilitate trimming or sizing. Breakage of the hanger along such a score line may result in removal of at least one of the plurality of clips from the hanger.

According to yet another aspect of an embodiment of a system according to the present invention, the clip body has a clip body diameter that is one of less than the tile aperture diameter, equal to the tile aperture diameter, and greater than the tile aperture diameter.

According to a further aspect of an embodiment of a system according to the present invention, each hanger body may be integrally molded with the plurality of clips supported thereon.

According to an embodiment of a method according to the present invention, a plurality of tiles is provided, where each tile includes at least one (but preferably a plurality, e.g., 2, 3, 4 or more) tile aperture(s) having a tile aperture diameter. At least one, but preferably a plurality of hangers is provided, wherein each hanger includes a plurality of (e.g., four) clips having a clip body and a clip aperture extending through the clip body. The clip body may be substantially cylindrical in shape (or have substantially the same cross-sectional shape as the tile aperture(s)), the body having a diameter that is preferably equal to or less than a mating diameter of the tile aperture(s). One or more fasteners may be provided, and an arrangement of tiles may be constructed by removably coupling the tiles to the hangers by inserting one clip into each tile aperture. The arrangement can be secured to a mounting surface (e.g., a wall) by inserting one of the fasteners through one of the clip apertures, or otherwise, such as by adhesive. The provided hanger(s) may include one or more score lines or grooves to facilitate breakage. The method may include the step of breaking at least one, but preferably fewer than all, provided hangers, where such breakage results in removal of one or more clips therefrom.

According to an aspect of an embodiment of an arrangement of tiles according to the present invention, the arrangement includes at least one hanger having a hanger body supporting a plurality of clips (e.g., 2, 3, 4, or more), the hanger body having a midline and a center point. The clips each have a clip body, and a clip prong extending from the clip body to a free end. A clip slot may be provided between the clip prong and the hanger body. The arrangement also includes a plurality of tiles, the tiles having a front surface, a back surface, at least one tile aperture, and a tile thickness. Each clip prong may be removably accepted by a tile aperture and a portion of a tile may be disposed within each clip slot.

According to another aspect of an embodiment of an arrangement of tiles according to the present invention, the clip body has a circular cross section and corresponding clip body diameter, and the tile aperture has a circular cross section and tile aperture diameter, where such clip body diameter and tile aperture diameter are approximately or substantially equal.

According to another aspect of an embodiment of an arrangement of tiles according to the present invention, each clip prong extends from a clip body in a direction substantially perpendicular to the hanger body midline.

According to still another aspect of an embodiment of an arrangement of tiles according to the present invention, each clip prong extends from its respective clip body in a direction substantially towards the hanger body center point.

According to still another aspect of an embodiment of an arrangement of tiles according to the present invention, the hanger may include one or more grooves or score lines, which may help facilitate breakage of the hanger body, where such breakage may result in removal of one or more clips.

An embodiment of a device according to the present invention may include a hanger body and a plurality of passive clips or hooks supported by the hanger body. The hanger body may include a hanger plate including a front surface, a back surface opposed from the front surface, two diametrically opposed vertical edges extending along the front surface and the back surface, two diametrically opposed horizontal edges extending along the front surface and the back surface between the two vertical edges, a center point, and a midline extending through the center point and substantially equidistant from the two horizontal edges. Each clip preferably includes a clip body having a clip body diameter. A clip aperture may extend completely through the clip body, the clip aperture having a clip aperture diameter (which is preferably less than the clip body diameter), wherein the clip aperture is configured to accept a fastener. A clip prong preferably extends from the clip body in one of: a direction substantially towards the center point, and a direction towards the midline and substantially parallel to the vertical edges. Each clip prong may have a clip prong length, a clip prong width, and a clip prong thickness.

According to an aspect of an embodiment of a device according to the present invention, the clip prong at least partially extends in a direction away from the front surface at a clip prong angle with respect to the front surface, wherein the clip prong angle is greater than zero.

According to another aspect of an embodiment of a device according to the present invention, a clip prong slot is disposed between the clip prong and the front surface.

According to another aspect of an embodiment of a device according to the present invention, the front and/or back surface includes a plurality of score lines formed therein to facilitate breakage of the hanger body, wherein breakage along the one or more score lines results in removal of one or more of the plurality of clips from the hanger body.

DESCRIPTION OF THE PREFERRED EMBODIMENT

Although the disclosure hereof enables those skilled in the art to practice the invention, the embodiments described merely exemplify the invention which may be embodied in other ways. While the preferred embodiment has been described, the details may be changed without departing form the invention, which is defined by the claims.

Figure 1:
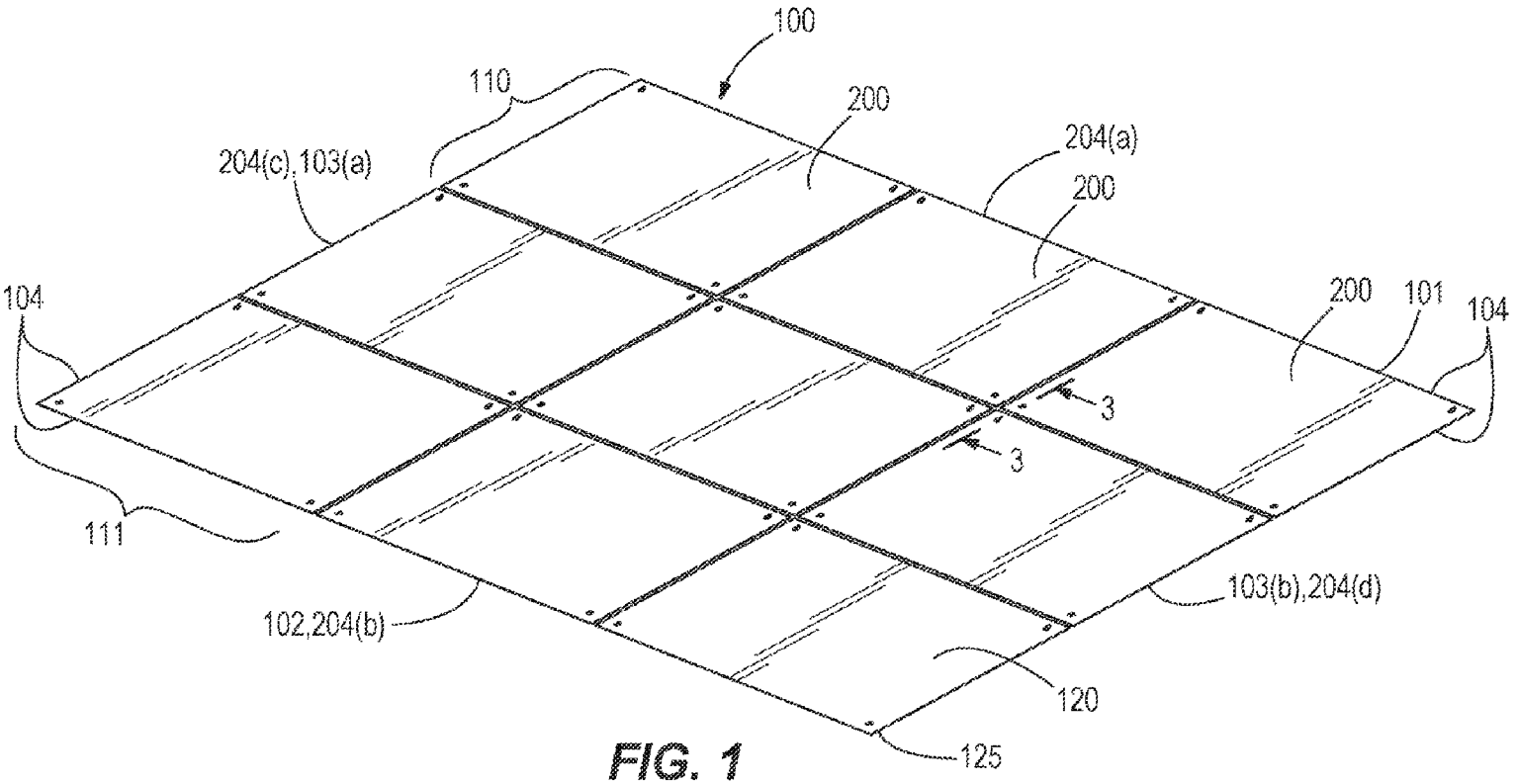
FIG. 1 is a first perspective view of an arrangement of tiles.
Figure 2:
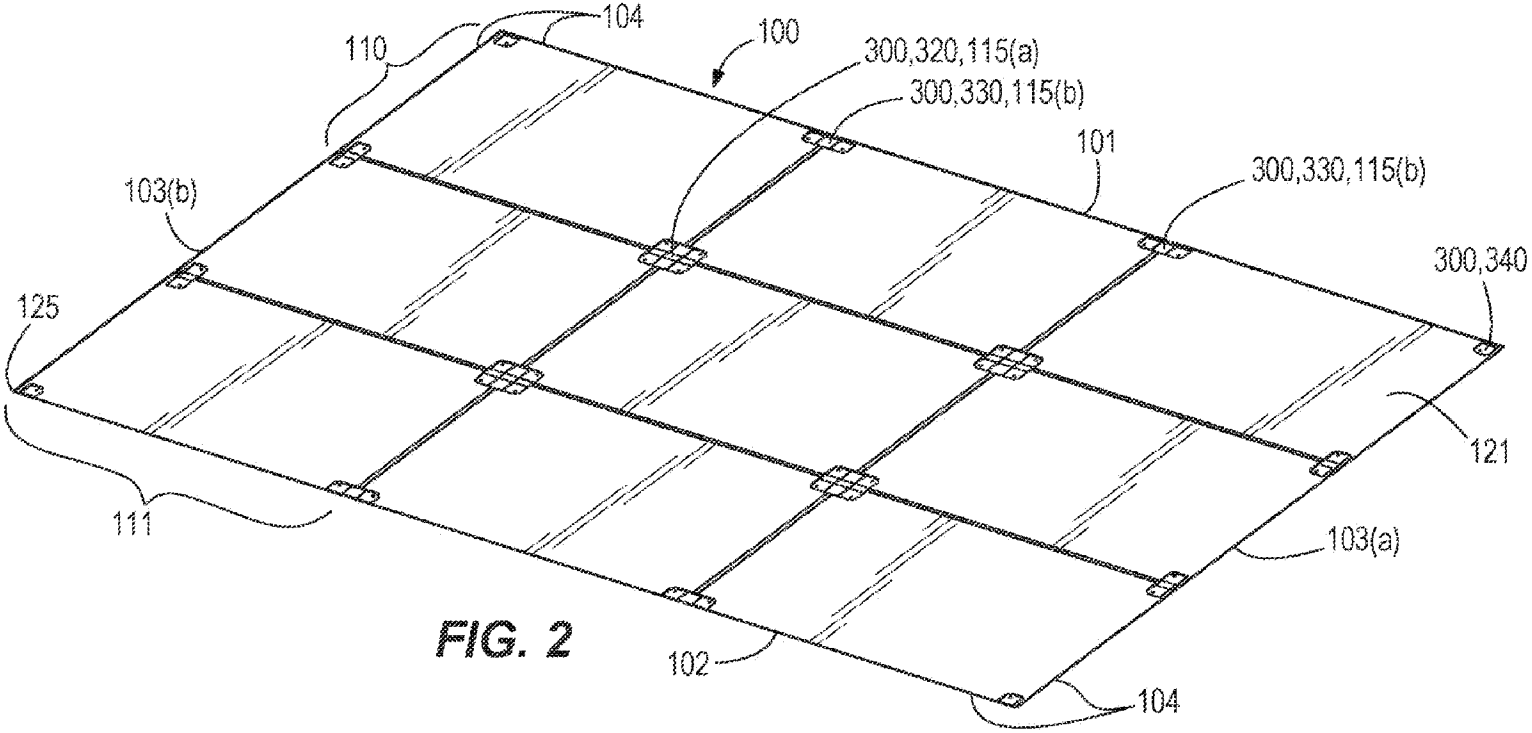
FIG. 2 is a second perspective view of the arrangement of tiles shown in FIG. 1.

Turning now to the figures, FIGS. 1 and 2 depict an embodiment 10 of a system related to the arrangement of tiles, including an embodiment 100 of an arrangement of tiles. The arrangement of tiles 100 is generally comprised of one or more tiles 200, one or more hangers 300, and one or more fasteners (see fasteners 500 of FIGS. 3-8).

The fasteners, which can take various forms (e.g., nail, screw, thumb tack, push pin, etc.), are used to secure the arrangement of tiles 100 to a mounting surface such as a wall, fence, plank, etc. According to an exemplary embodiment, the fasteners, which include a fastener shank, are configured to secure the arrangement of tiles 100 to the mounting surface in a temporary or removable fashion, thereby minimizing damage to the surface because of fastening. In other embodiments, the fasteners may also be configured to more permanently secure the arrangement of tiles 100 to the mounting surface (e.g., by screw which may be configured to be received by a wall anchor embedded within the mounting surface).

The arrangement of tiles 100 also includes a front surface 120 and a back surface 121, where the front surface 120 is preferably configured to face away from the mounting surface, while the back surface 121 faces the mounting surface. According to an exemplary embodiment, the one or more hangers 300 are coupled to the one or more tiles 200 along the back surface 121 of the arrangement of tiles 100. In such an arrangement, the hangers 300 are concealed from view when the front surface 120 of the arrangement of tiles 100 is viewed.

When the arrangement of tiles 100 is created, one or more exterior edges 104 of the arrangement of tiles 100 are formed. The exterior edges 104 represent the boundary of the arrangement of tiles 100. Conversely, the interior of the arrangement of tiles 100 is the portion within the exterior edges 104.

Figure 3:
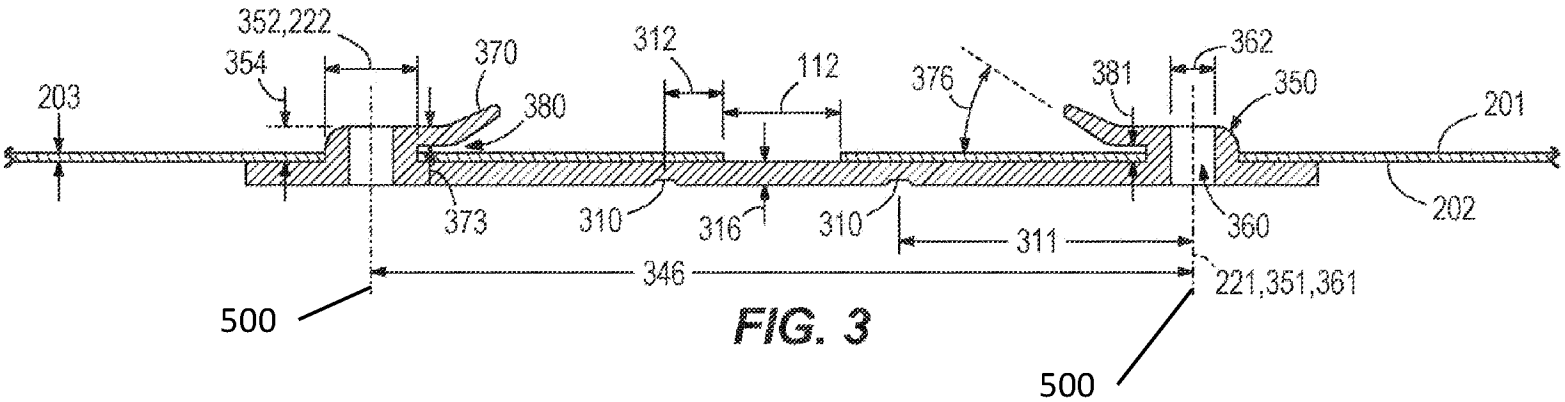
FIG. 3 is a cross-section view of the arrangement of tiles shown in FIG. 1.
Figure 4:
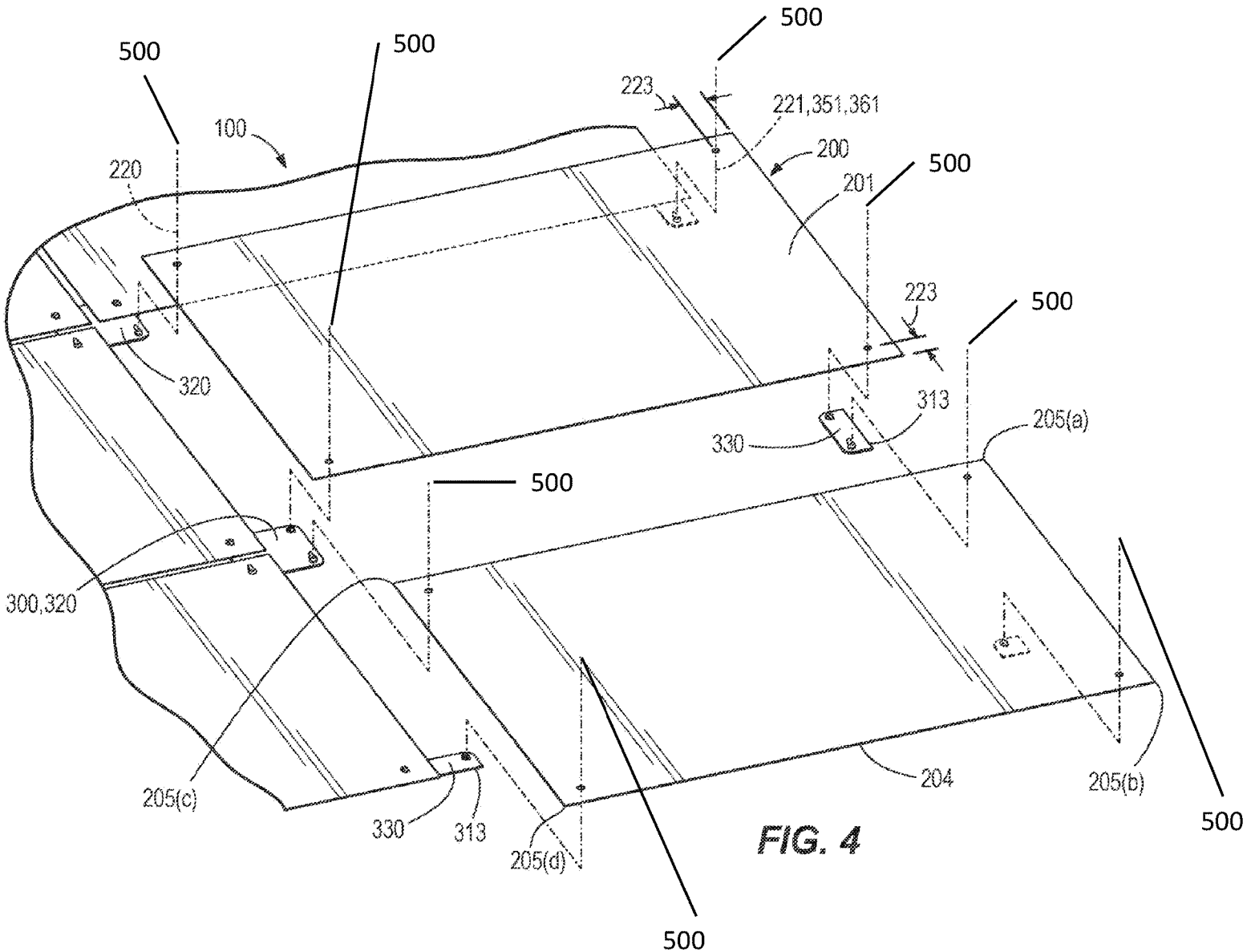
FIG. 4 is a partial assembly view of the arrangement of tiles shown in FIG. 1.

The arrangement of tiles 100 is formed when the one or more tiles 200 are removably joined using the one or more hangers 300, as shown in FIGS. 3-4. Specifically, each tile 200 is mounted to one or more hangers 300. When a plurality of tiles 200 are mounted to one or more hangers 300, the plurality of tiles 200 are removably coupled together and configured in an arrangement of tiles 100.

As shown in FIG. 2, the one or more hangers 300 can take various shapes. Specifically, hangers 300 can be configured as full hangers 320, half hangers 330, and quarter hangers 340, as described in detail below. Likewise, while FIGS. 1 and 2 depict tiles 200 having generally rectangular shape, tiles can take various shapes (e.g. triangular, circular, etc.) in other embodiments described in greater detail below.

According to an exemplary embodiment, each hanger 330 is capable of accepting one, two, three, or four tiles 200, depending upon whether the hanger 330 is configured as a full hanger 320 (capable of accepting four tiles 200), a three-quarter hanger (capable of accepting three tiles 200), a half hanger 330 (capable of accepting two tiles 200), or a quarter hanger 340 (capable of accepting one tile 200). While described with reference to a full hanger including four clips, it is to be understood that the hangers 300 may be originally formed with a predetermined number (e.g., one, two, three, four, or more) of clips. When two or more tiles 200 are mounted to a single hanger 300, a joint 115 is formed. Each joint 115 therefore includes two or more tiles 200 removably coupled to a hanger 300. Because the two or more tiles 200 are mounted to a single hanger 300 when a joint 115 is formed, each of the two or more tiles 200 bear some positional relationship the other tiles 200 also coupled at the joint 115.

When a joint 115 is formed, a gap 112 may be created between each of the mounted tiles 200. The gap 112 comprises a space between adjacent tiles 200. In an exemplary embodiment, the gap 112 is formed as a uniform Distance, as described in detail below.

As shown in FIG. 4, there are different types of joints 115, namely interior joints 115(*a*) and exterior joints 115(*b*). Interior joints 115(*a*) are created when a full hanger 320 is used to join four tiles 200 together (i.e. when the joint 115 is located within the interior of the arrangement of tiles 100). Conversely, exterior joints 115(*b*) are created when a half hanger 330 is used to join together two tiles 200 along the exterior of the arrangement of tiles 100. In other embodiments, a three-quarter hanger (e.g., with one clip removed) can be used to create an joint 115, namely an exterior joint 115(*b*), in which three tiles 200 are joined. A three-quarter hanger might be used, for example, if the tile 200 in a corner is omitted from an otherwise rectangular arrangement of tiles 100.

FIG. 4 also depicts an instance when a hanger 300 is used, but when no joint 115 is formed. In particular, quarter hangers 340 can be used as a means to fasten a corner 125 of the arrangement of tiles 100 to the mounting surface. In such instances, the primary use of the hanger is to secure the arrangement of tiles 100 to the mounting surface, rather than to join one tile 200 to another tile 200. Therefore, a quarter hanger 340 is sufficient to provide a means to fasten the corner 125 of the arrangement of tiles 100 to the mounting surface.

In a preferred embodiment, the one or more tiles 200 are of uniform size and shape. Accordingly, the arrangement of tiles 100 is generally comprised of tiles 200 arranged in a grid-like pattern, like that shown in FIGS. 1 and 2. In such an arrangement, the grid-like pattern of the one or more tiles 200 forms one or more tile rows 110 and tile columns 111.

As depicted in FIGS. 1 and 2, the arrangement of tiles 100 is preferably configured to have a generally rectangular shape. In this configuration, the arrangement of tiles 100 includes an upper edge 101, a lower edge 102, two side edges 103(*a*) and 103(*b*), and four corners 125. In such an embodiment, the force of gravity generally acts in a direction from the upper edge 101 to the lower edge 102. The upper edge 101 of the arrangement of tiles 100 is formed by the upper tile edge 204(*a*) of the tiles 200 in the upper tile row 110. The lower edge 102 of the arrangement of tiles 100 is formed by the lower edge 204(*b*) of the tiles 200 in the lower tile row 110. The side edges 103(*a*) and 103(*b*) are formed by the left tile edge 204(*c*) of the tile 200 comprising the left tile column 111 and the right tile edge 204(*d*) of the tiles 200 comprising the right tile column 111.

In this preferred embodiment, the upper edge 101 is formed as a straight horizontal edge, where the upper edge 101 is collinear with the upper tile edges 204(*a*) of the one or more tiles 200 in the upper tile row 110. Likewise, the lower edge 102 is formed as a straight, horizontal edge, where the lower edge 102 is collinear with the lower tile edges 204(*b*) of the one or more tiles 200 in the lower tile row 110. In addition, the side edges 103(*a*) and 103(*b*) are formed as straight, vertical edges, where the side edges 103(*a*) and 103(*b*) are collinear with the left tile edges 204(*c*) of the one or more tiles 200 in the left tile column 111 and the right tile edges 204(*d*) of the one or more tiles 200 in the right tile column 111, respectively.

When configured as a rectangle, the arrangement of tiles 100 can be constructed using hangers 300 in multiple sizes. Specifically, full hangers 320 are used to couple four tiles 200 together (i.e. at interior joints 115(*a*)), half hangers are used to couple two tiles together (i.e. at exterior joints 115(*b*)), and quarter hangers are used to couple only one tile (i.e. at a corner 125 of the arrangement of tiles 100).

Referring now to FIGS. 3 and 4, the one or more tiles 200 include a front tile surface 201, a back tile surface 202, one or more tile apertures 220, one or more edges 204, and a tile thickness 203. According to an exemplary embodiment, the tiles 200 are constructed using a thin material, such as paper, cardstock, plastic sheeting, etc. Moreover, the tiles 200 can be configured to have one or more of the following qualities: waterproof, scratch-resistant, tear-resistant, bend-resistant, UV-resistant, recyclable, manufactured from recycled materials (e.g., post-consumer recycled materials), etc. When a tile has more than one edge 204, which is the case when the tile 200 is configured to have a triangular shape, rectangular shape, pentagonal shape, etc., two edges meet to form a corner 205. In the case of a rectangular tile 200, for example, each the four edges 204 meet at four corners 205.

The tiles 200 are configured to have one or more tile apertures 220, which are formed through the tile 200 (i.e. extending from the front surface 201 through the back surface 202). Each tile aperture 220 has a tile aperture diameter 222 and a tile aperture axis 221. In an exemplary embodiment, the tile aperture 220 is formed as a circular hole. In such an embodiment, the tile aperture axis 221 extends through the center of the circular tile aperture 220. However, it is contemplated that the tile aperture 220 could also be configured to have a rectangular, triangular, or some other shape. In such cases, the tile aperture axis 221 can be formed in the center of the tile aperture 220, or, in the case of a slot-shaped tile aperture, the tile aperture axis 221 can be positioned at some point along a center line of the slot.

Each tile aperture 220 can be formed proximate to one or more of the edges 204 of the tile 200. Specifically, the tile aperture 220 is formed at a tile aperture distance 223 from the tile edge 204. When the tile 200 is formed in a shape having more than one edge 204, the tile aperture 220 may be formed in a position equidistant from all proximate edges 204. For example, if the tile 200 features a generally rectangular shape, the tile aperture 220 can be positioned a first distance from a first edge and a second distance from a second edge where the first distance and second distance are substantially identical and substantially equal to the tile aperture distance 223. In other words, the tile aperture 220 is positioned at a distance substantially equal to the tile aperture distance 223 from each proximate edge 204. For example, when a tile aperture 220 is positioned proximate to a tile corner 205 of the tile 200, the tile aperture 220 is located the tile aperture distance 223 from both edges 204 that meet to form the corner 205, as shown in FIG. 4.

According to an exemplary embodiment, the tiles 200 are configured to have a generally rectangular shape with four corners 205 and four edges 204. Specifically, each tile 200 includes an upper right tile corner 205(*a*), an lower right tile corner 205(*b*), a upper left tile corner 205(*c*), and a lower left tile corner 205(*d*). In such an embodiment, a tile aperture 220 is formed through the tile 200 (i.e. through both the front tile surface 201 and the back tile surface 202) at each of the four tile corners 205 (i.e. at the upper right tile corner 205(*a*), lower right tile corner 205(*b*), upper left tile corner 205(*c*), and lower left tile corner 205(*d*)).

In an exemplary embodiment, the front tile surface 201 of the tiles 200 will include an artistic design, pattern, image, etc. Moreover, in some embodiments, it is advantageous for the back tile surface 202 to include a design, pattern, image, etc. as well. Each tile 200 can be configured to comprise one portion of a larger design, pattern, image, etc. such that when the tiles 200 are mounted to hangers 300 in order to form the arrangement of tiles 100, the arrangement of tiles 100 will display a larger contiguous design, pattern, image, etc. Conversely, each tile 200 can be configured to display a unique design, pattern, image, etc. that is distinct from the designs, patterns, images, etc. of some or all of the other tiles 200 included in the arrangement of tiles 100 (e.g., to form a collage). When the tiles 200 comprise a portion of a larger design, pattern, or image, it is understood that each tile 200 will have one or more specific position within the broader arrangement of tiles 100 so that the larger design, pattern, image, etc. may be created. For example, if the arrangement of tiles 100 is configured to display a city skyline image, the tile 200 displaying only a spire that sits atop a skyscraper should be positioned within the arrangement of tiles 100 so that the arrangement of tiles 100 correctly displays the spire atop the skyscraper (as opposed to beneath the skyscraper, for example).

In other embodiments, the tiles 200 could be configured to be transparent, translucent, or opaque. In such embodiments, the tile 200 could be transparent, translucent, or opaque and also bear some pattern, design, or image. The front tile surface 201 and the back tile surface 202 could also be textured, smooth, matte, glossy, or some combination thereof. For example, one or more tiles 200 may feature a front tile surface 201 having a glossy white design so as to enable one to draw on the tile 200 using a dry erase marker. In other embodiments, one or more of the tiles 200 could have a front tile surface 201 configured as a matte black surface to enable one to write on the tile 200 using chalk, for example.

While exemplary embodiments may utilize tiles 200 having a static design, pattern, or image, tiles 200 producing a dynamic image may be used in other embodiments. For example, the tiles 200 may bear a changing LED light pattern, design, or image, or the tiles 200 may be configured to contain a thin LCD screen capable of displaying a digital image, such as a video.

Referring now to FIGS. 5-8, the one or more hangers 300 include a hanger body 315, a front hanger surface 301, a back hanger surface 302, one or more edges 304, one or more clips 345, and a clip distance 346. In an exemplary embodiment, the hanger body 315 is a thin, plate-like structure. The one or more clips 345 protrude from the front hanger surface 301.

Figure 5:
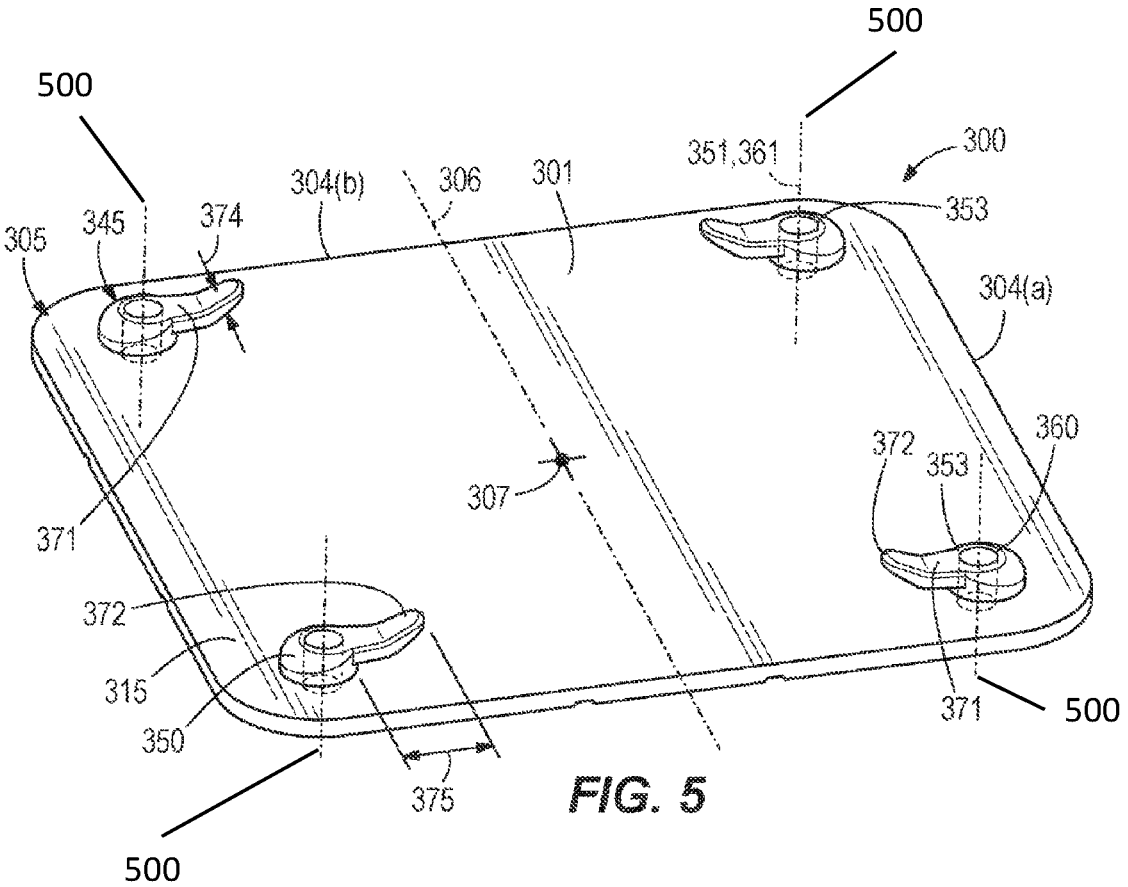
FIG. 5 is a first perspective view of a first embodiment of a hanger according to the present invention.
Figure 6:
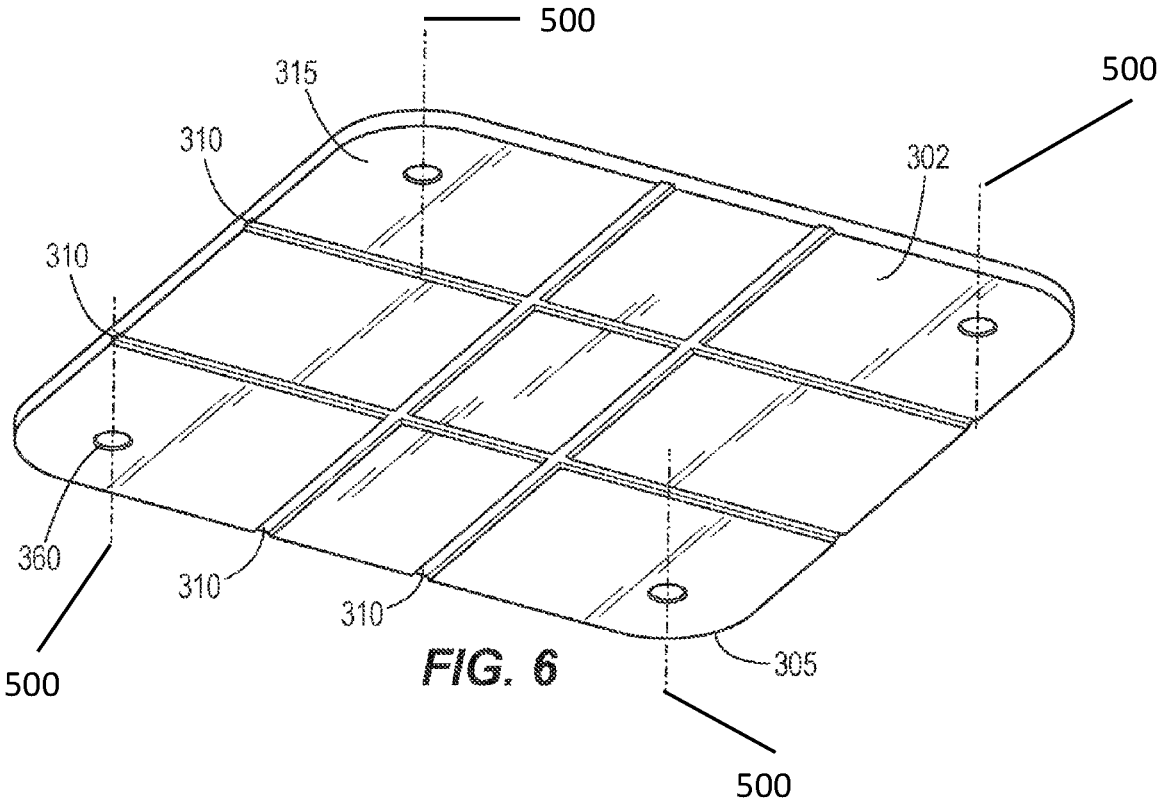
FIG. 6 is a second perspective view of the hanger of FIG. 5.

As shown in FIGS. 5 and 6, the hanger body 315 may be configured to have a generally rectangular shape. In such an embodiment, the hanger body 315 has four hanger corners 305, two horizontal hanger edges 304(*a*), and two vertical hanger edges 304(*b*). The hanger corners 305 may optionally feature a radius.

Figure 7:
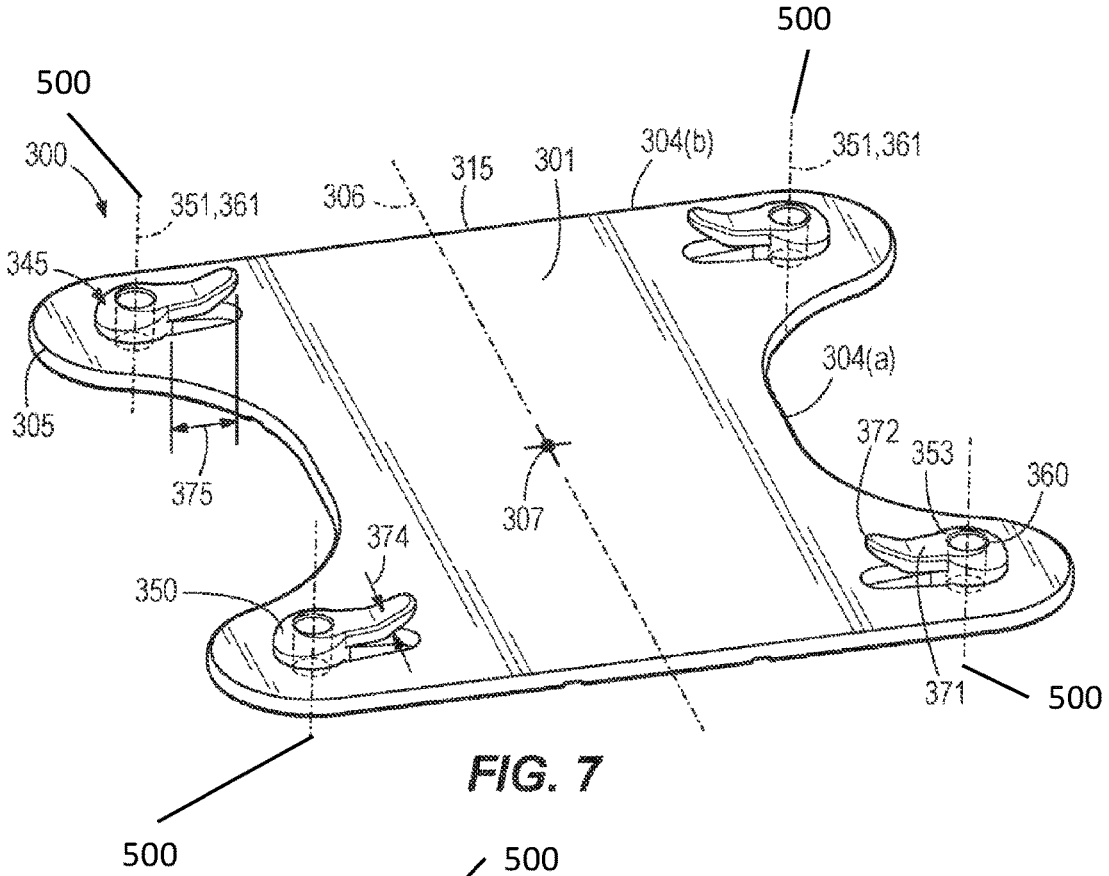
FIG. 7 is a first perspective view of a second embodiment of the hanger according to the present invention.
Figure 8:
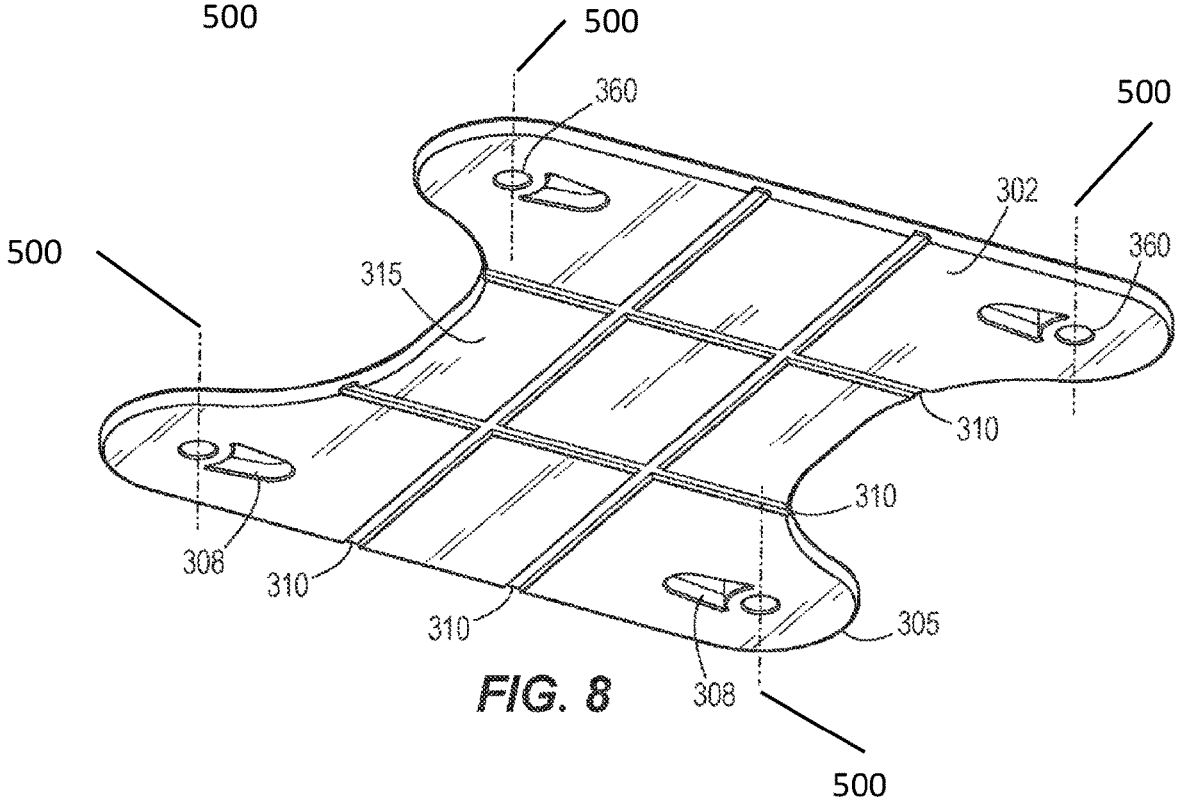
FIG. 8 is a second perspective view of the hanger of FIG. 7.
Figure 9:
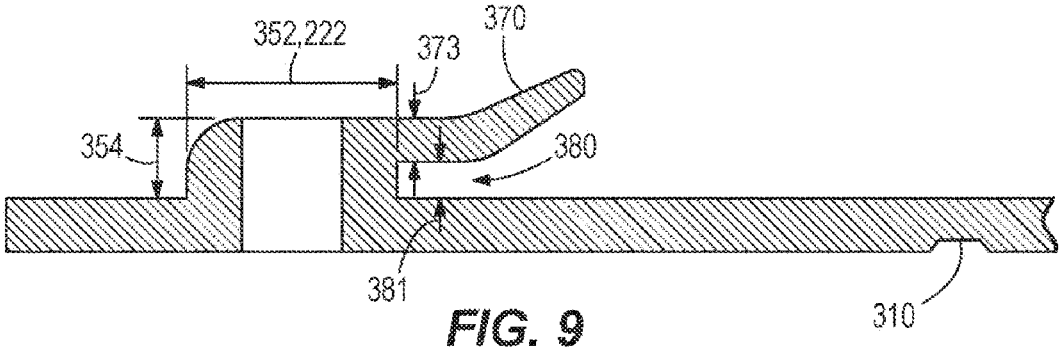
FIG. 9 is a partial cross-section view of the hanger of FIG. 5.
Figure 10:
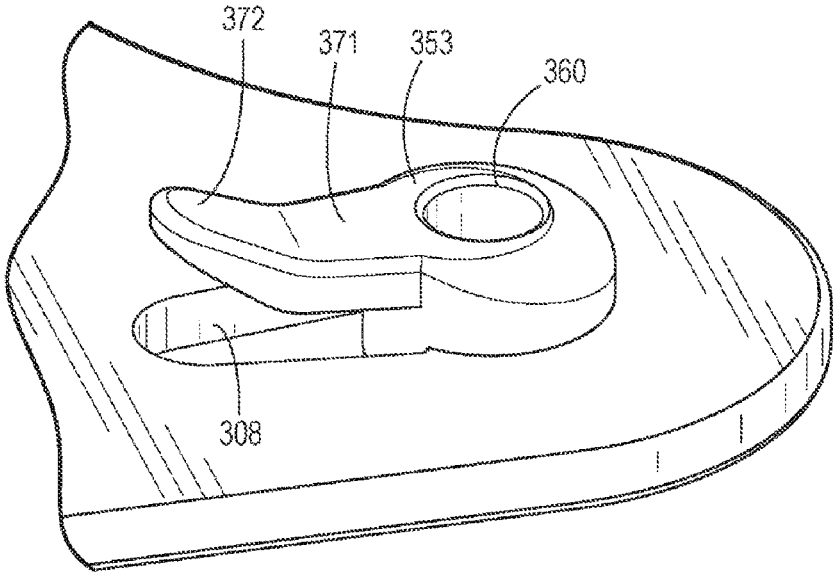
FIG. 10 is partial perspective view of the hanger of FIG. 7.

As shown in FIGS. 7 and 8, the hanger body 315 can also be formed as in an hourglass shape. More specifically, the hanger body 315 can have two parallel vertical hanger edges 304(*b*) and two curved hanger edges 304(*a*) where the curved edges 304(*a*) are symmetrical about a midline 306 of the hanger body 315. Moreover, the hanger body 315 can also have a center point 307. In this embodiment, the curved edges 304(*a*) extend inward towards the midline 306 of the hanger body 315, thus creating a void between two clips 345. This may be done, for example, to decrease the amount of material used to produce the hanger 300.

To create the arrangement of tiles 100 according to an exemplary embodiment, a plurality of hangers 300 will be used. As shown in FIG. 4, the plurality of hangers 300 are used to join a plurality of tiles 200. As described above, hangers 300 can take a variety of configurations, including full hangers 320, half hangers 330, or as quarter hangers 340, or even three-quarter or three-clip hangers. According to an exemplary embodiment, each hanger 300 includes four clips 345. In this configuration, then, a full hanger 320 will include four clips 345, a half hanger 330 will include two clips 345, and a quarter hanger 340 will include one clip 345. Additionally, if a single clip 345 is removed, then a three-clip hanger may be formed.

As described above, a full hanger 320 is used when four tiles 200 are coupled together at a single joint 115. Thus, four clips 345 are required to create such a joint 315 (i.e. one clip 345 to couple to one tile aperture 220 for each of the four joined tiles 200). Likewise, when a joint 115 is formed using only two tiles 200, a half hanger 330 is required. Thus, only two clips are required to create such a joint 115 (i.e. one clip 345 to couple to one tile aperture 220 of the two joined tiles 200). Finally, a quarter hanger 340 is used to fasten the tile corner 205 of a single tile 200 at the corner 125 of the arrangement of tiles 200.

In exemplary embodiments, the back hanger surface 320 contains one or more score lines 310 formed therein. The score lines 310 may be formed as shallow grooves within the back hanger surface 302 and are purposed to facilitate the breaking of the hanger body 315 along one or more score lines 310. While full hangers 320, half hangers 330, and quarter hangers 340 can each be separately manufactured, the score lines 310 enable a full hanger 320 to be transformed into one or more half hangers 330 or one or more quarter hangers 340 by breaking the full hanger 320 along one or more score lines 310.

As shown in FIG. 4, when the arrangement of tiles 100 is assembled according to an exemplary embodiment, full hangers 320 (i.e. a hanger 300 where the hanger body 315 has not been broken along a score line 310), half hangers 330 (i.e. a hanger 300 that has been broken along one score line 310 such that two clips 345 remain, according to an exemplary embodiment), and quarter hangers (i.e. a hanger 300 that has been broken along two score lines 310 such that one clip 345 remains) are used. Moreover, three-quarter hangers can be created if a hanger 300 has been broken along a portion of two score lines 310, but where the score line 310 is not broken from a first edge 304 to the opposite edge 304 (i.e. when the score line 310 is not broken from one vertical edge 304(*b*) to the other vertical edge 304(*b*), but is instead broken from one vertical edge 304(*b*) to some point proximate to the hanger midline 306 or center point 307). By using score lines 310, it is possible for a single hanger 300 embodiment, such as the hanger 300 depicted in FIGS. 5-6 or FIGS. 7-8, to be used to create full hangers 320, three-quarter hangers, half hangers 330, and quarter hangers 340, thus obviating the need for separate hanger 300 designs or separate manufacturing of half hangers 330 and quarter hangers 340.

Score lines 310 can extend in both the vertical direction (i.e. parallel to the vertical hanger edges 304(*b*)) or in the horizontal direction (i.e. parallel to the horizontal hanger edges 304(*a*) shown in FIGS. 5 and 6 or perpendicular to the horizontal hanger edges shown in FIGS. 7 and 8). According to an exemplary embodiment, there are two horizontal score lines 310 and two vertical score lines 310, where one horizontal score line 310 is positioned closer to one horizontal hanger edge 304(*a*) and the other horizontal score line 310 is positioned closer to the other horizontal hanger edge 304(*a*). Likewise, one vertical score line 310 is positioned closer to one vertical hanger edge 304(*b*), while the other vertical score line 310 is positioned closer to the other vertical hanger edge 304(*b*).

The score lines 310 can be located at a score line distance 311 from the clip aperture axis 361. According to an exemplary embodiment, the score line distance 311 may be equal to or less than the tile aperture distance 223. When so arranged, an overlap distance 312 is created when the tile 200 is coupled to the hanger 300, as described in further detail below. The overlap distance 312 is equal to the distance that the tile 200 extends beyond the score line 310 of the hanger 300.

The score lines 310 are configured to permit a user to break the hanger body 315 along the score line 310 so as to create a half hanger 330 or quarter hanger 340 from a hanger 300. (Relatedly, when the score lines 310 are not broken, the hanger 300 is a full hanger 320.) According to an exemplary embodiment, the score lines 310 are configured to enable a user to break the hanger body 315 along the score line 310 with only nominal force, such as by hand or using a small pliers. When the hanger 300 is broken along the score line 310, a broken edge 313 is formed.

Referring now to FIGS. 3-8, the hanger 300 includes one or more clips 345. Moreover, the hanger 300 is configured to have a clip distance 346. The clips 345 include a clip body 350, a clip slot 380 having a clip slot height 381, a clip prong 370, and a clip aperture 360 having a clip aperture axis 361 and a clip aperture diameter 362. The clip body 350 protrudes from the front hanger surface 301 and has a clip body height 354, a clip body top 353 and a clip body axis 351. The clip body height 354 may be configured to be approximately equal to the hanger thickness 316 or slightly larger. Moreover, the clip body height 354 is preferably configured be greater than the tile thickness 203. Moreover, the clip slot height 381 is preferably configured to be greater than or equal to the tile thickness 203. In an exemplary arrangement of tiles 100 created using a plurality of tiles 200 having a uniform tile thickness 203, the clip body height 354 may be approximately twice as large as the tile thickness 203. Similarly, in preferred embodiments the clip slot height 381 will be approximately equal to the tile thickness 203. In embodiments using tiles 200 having varied tile thickness 203, it may be necessary to have a clip body height 354 approximately equal to two times the largest tile thickness 203, or more.

The clip distance 346 is equal to the distance between the clip body axis 351 of two adjacent clips. As described in further detail below, the clip distance 346 and the tile aperture distance 223 dictate the gap 112 that exists between tiles 200 when two or more tiles are mounted to a single hanger 300.

The clip body top 353 is defined by the top surface of the clip body 350 formed by a plane parallel to the front hanger surface 301. According to an exemplary embodiment, the clip body 350 features a circular cross section, thus forming a clip body diameter 352 and the clip body axis 351. In such embodiments, the clip body diameter 352 may be configured to be approximately equal to the tile aperture diameter 222. When the arrangement of tiles 100 is assembled, the clip body 350 is inserted into the tile aperture 220; if the tile aperture diameter 222 and the clip body diameter 352 are approximately equal, the clip body 350 will fit snugly within the tile aperture 220. If the tile aperture diameter 222 is less than the clip body diameter 352, it is possible (depending upon the tile 200 material) that the clip body 350 will not fit within the tile aperture 220. Conversely, if the tile aperture diameter 222 greatly exceeds the clip body diameter 352, the secure coupling of the tile 200 to the hanger 300 may not be obtained.

The clip prong 370 may extend from the clip body 350 in a direction generally towards the hanger midline 306. The clip prong 370 has a clip prong length 375, a clip prong width 374, and a clip prong thickness 373. Furthermore, the clip prong 370 may be configured to have a clip prong body 371 and a clip prong tip 372.

The clip prong 370 is configured to be inserted into the tile aperture 220 as the arrangement of tiles 100 is assembled, as shown in FIG. 4. Therefore, the clip prong width 374 must be lesser than the tile aperture diameter 222. Moreover, the clip prong width 374 may vary along the clip prong length 375. For example, the clip prong tip 372 may feature a clip prong width 374 that is lesser than the clip prong width 374 along the clip prong body 371. In an exemplary embodiment, the clip prong width 374 would decrease gradually from the clip prong tip 372 towards the clip prong body 371 such that the clip prong width 374 is substantially equal to the clip body diameter 352 where the clip prong 370 meets the clip body 350. In this configuration, the clip prong 370 has a generally pointed shape, as shown in FIGS. 5 and 7.

Likewise, the clip prong thickness 373 may vary along the clip prong length 375. For example, the clip prong tip 372 may feature a clip prong thickness 373 that is lesser than the clip prong thickness 373 along the clip prong body 371. In an exemplary embodiment, the clip prong thickness 373 would increase gradually from the clip prong tip 372 towards the clip prong body 371. The clip prong thickness 373, however, may not be greater than the clip body height 354. In other words, the clip prong thickness 373 is preferably configured to be lesser than the clip prong height 354 so that the clip prong slot 380 may be formed, as discussed below.

The clip prong length 375 can be configured to be approximately equal to the clip body diameter 352, can extend to the hanger midline 306, or can take some intermediate length. According to an exemplary embodiment, however, the clip prong length 375 will be slightly larger than the clip body diameter 352. It is advantageous to configure the clip prong length 352 to be small (e.g. slightly larger than the clip body diameter) so as to minimize the visible portion of the hanger 330 when the clip prong 370 is inserted through the tile aperture 220 when the tile 200 is mounted to the hanger 300.

As shown in FIGS. 5-8, the clip prong 370 may be aligned to be substantially parallel with the vertical hanger edges 304(*b*). However, other embodiments may include clip prongs 370 aligned at a forty-five-degree angle from the vertical hanger edge 304(*b*). In such embodiments, the clip prong 370 can be positioned at a forty-five-degree angle towards the center point 307 of the hanger body 315 or at a forty-five-degree angle towards the proximate vertical hanger edge 304(*b*). In addition, it is possible for the clip prongs 370 to be positioned at some other angle from the vertical hanger edge 304(*b*), but exemplary embodiments will preferably feature clip prongs 370 positioned at an angle no greater than forty-five degrees from the vertical hanger edge 304(*b*) in either direction.

The clip prong body 371 also remains substantially parallel to the clip body top 353 the front hanger surface 301, and the back hanger surface 302. The clip prong tip 372, however, may extend from the clip prong body 371 at a clip prong angle 376 where the clip prong angle 376 is greater than zero. As shown in FIG. 3, the clip prong tip 372 thus flares upwards when the clip prong angle 376 is greater than zero. In this configuration, the clip prong tip 372 is not parallel with the clip body top 353, front hanger surface 301, or back hanger surface 302. According to an exemplary embodiment, the clip prong tip 372 would extend from the clip prong body 371 at an ascending angle approximately between fifteen and forty-five degrees. In such embodiments, the elevated clip prong tip 372 will facilitate the insertion of the clip prong 370 into the tile aperture 220.

Because the clip prong 370 extends from the clip body top 353 and has a clip prong thickness 373 less than the clip body height 354, a clip slot 380 is formed in between the clip prong 370 and the front hanger surface 301. The clip slot 380 has a clip slot height 381 that may be configured to be substantially equivalent to the tile thickness 203. When the arrangement of tiles 100 is assembled, a portion of the tile 200 will be secured within the clip slot 380 (i.e. over the front hanger surface 301 but underneath the clip prong 370, as shown in FIG. 3). The clip slot height 381, therefore may be configured to be slightly larger than the tile thickness 203, according to an exemplary embodiment. In order to accommodate a plurality of tiles 200 having a variety of tile thicknesses 203, the clip slot height 381 may be approximately equal to the tile thickness 203 of whichever tile 200 has the greatest tile thickness 203.

The clip aperture 360 is formed through the clip body 350 and extends through the back hanger surface 302. Moreover, the clip aperture axis 361 and the clip body axis 351 are substantially concentric. According to an exemplary embodiment, the clip aperture 360 has circular cross section and a diameter equal to the clip aperture diameter 362. The clip aperture diameter 362 may preferably be configured to accept a fastener 500 used to hang the arrangement of tiles 100 to the mounting surface as described above. Moreover, the clip aperture diameter 362 may ideally be only slightly larger than a fastener shank. In other embodiments, the clip aperture 360 may have a slightly conical shape, where the clip aperture diameter 362 is slightly smaller at one end (i.e. at the clip body top 351) than at the other end (i.e. at the back hanger surface 302 so as to facilitate fastening and alignment (e.g., leveling, etc.) of the arrangement of tiles 100 to the mounting surface. The clip body 350 may also be provided without any clip aperture(s) 360, such that the front hanger surface 301 of the clip body 350 is imperforate. In this way, a hanger 300 may be coupled to a support structure (e.g., wall, window, etc.) using various known mounting compounds, such as adhesive, caulk, glue, tape (e.g., double-sided tape), putty, or rubber cement.

As shown in FIGS. 3 and 4, when the tile 200 is coupled to the hanger 300, whether a full hanger 320 half hanger 330, or quarter hanger 340, the tile aperture axis 221, the clip aperture axis 361, and the clip body axis 351 will be substantially concentric, as shown in FIGS. 3 and 4. Accordingly, when a fastener 500 such as a nail, screw, etc. is used to fasten the arrangement of tiles 100 to the mounting surface, the fastener will be inserted through the clip aperture 360, which is configured to extend through the clip body 350, which is in turn accepted by the tile aperture 220 as described above.

Also shown in FIG. 3 is the gap 112 that is created when two or more tiles 200 are mounted to a single hanger 300. The size of the gap 112 is determined by the clip distance 346 and the tile aperture distance 223. Specifically, the gap 112 is equivalent to the clip distance 346 minus two times the tile aperture distance 223. If the clip distance 346 greatly exceeds the two times the tile aperture distance 223, for example, the gap 112 will be large. Conversely, if the clip distance 346 is roughly equivalent to two times the tile aperture distance 223, the gap 112 will be nominal. According to an exemplary embodiment, the gap 112 is nominal such that the arrangement of tiles 100 features tiles 200 that are arranged in close proximity to one another, thus creating an arrangement of tiles 100 that appears to be a single image, pattern, or design, etc. rather than an combination of multiple tiles 200.

As referenced above and depicted in FIG. 3, the overlap distance 312 is equal to the distance that the tile 200 extends beyond the score line 310 when the tile 200 is mounted to the hanger 300. Because the overlap distance 312 is equal to or greater than zero (as opposed to being less than zero), the tile 200 will hang over the broken edge 313 of the half hanger 330 or quarter hanger 340. For this reason, when a half hanger 330 or quarter hanger 340 is used along the border of the arrangement of tiles 100, the hanger body 315 will be substantially hidden from view when the front surface 120 is viewed.

The hanger 300 may be composed of a plastic or polymeric material, according to exemplary embodiments. In such embodiments, an injection molding process may be used to create the hanger 300. When an injection molding process is used, it may be advantageous to include optional voids 308 in the hanger body 315 that are located directly beneath the clip prongs 370 to facilitate manufacturing, as shown in FIGS. 7 and 8. While a plastic or polymeric material may be used in exemplary embodiments, it is contemplated that other materials could easily be used. For example, sheet metal material and a metal stamping process could be used, to produce the hanger 300. According to exemplary embodiments, the hanger 300 may be produced using a plastic or polymeric material having transparent or translucent properties. In this configuration, the hanger 300 is not easily visible when used in the arrangement of tiles 100.

The hanger 300 may be configured as a unitary component, or it may be configured as an assembly of subcomponents. In an assembled state, for example, the hanger 300 could be composed of a hanger body 315 cut from thin plastic sheeting, while each of the clips 345 could be molded separately via injection molding process. The clips 345 could then be mated to the hanger body 315 using adhesive via plastic welding, for example.

While the exemplary embodiment depicted in FIGS. 1 and 2 and described herein features an arrangement of tiles 100 where the tiles 200 are rectangular in shape arranged in a rectangular grid-like pattern, it is possible for alternative arrangements of tiles 100 to be created. For example, if the tile aperture 220 were not located proximate to two tile edges 204 at a single tile aperture distance 223 from each edge 204, but instead located proximate to only one tile aperture edge 204 (i.e. if the tile aperture 220 were located away from the tile corner 205), some other arrangement of tiles 100 would result. This arrangement could feature tile rows 110, but no discernable tile columns 111 (i.e. a tile row 110 is offset from an adjacent tile row 110). Alternative arrangements could also feature tile columns 111, but not discernable tile rows 110 (i.e. one tile column 111 is offset from an adjacent tile column 111). Furthermore, alternative arrangements could feature non-rectangular tiles 200 arranged in a rectangular or non-rectangular pattern. In any such alternative embodiments, it may also be necessary for the hangers 300 to be modified by, for example, repositioning the clips 345 or score lines 310 to create the appropriate joints 115 or gaps 112 necessary to facilitate a particular arrangement of tiles 100.

According to some aspects of embodiments according to the present invention, a plurality of components as discussed herein may be advantageously provided in a kit form (e.g., in a single compartment and/or in different compartments in a single package). A kit according to the present invention may include a tile 100 and a hanger 300; a single tile 100 and a plurality of hangers 300; a plurality of tiles 100 and a plurality of hangers 300; a plurality of tiles 100; or a plurality of hangers 300.

The foregoing is considered as illustrative only of the principles of the invention. Furthermore, because numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A method for arranging a plurality of tiles on a structure, the method comprising the steps of:

providing the plurality of tiles, wherein each tile of the plurality of tiles comprises a tile aperture;

providing a plurality of hangers, wherein each hanger of the plurality of hangers comprises a hanger body and a plurality of clips attached to the hanger body, wherein each clip of the plurality of clips comprises a clip body configured for an attachment to the structure;

wherein each clip body of each clip comprises:

a clip prong with a clip prong body and a clip prong tip that extends from the clip prong body toward a hanger midline to form a clip slot; and a clip aperture that extends through the clip and the clip body, wherein the clip aperture is configured to accept a fastener therethrough for the attachment to the structure;

removably coupling tiles of the plurality of tiles to hangers of the plurality of hangers by inserting clip prong tips of clip prongs of clips of the hangers through tile apertures of the tiles such that portions of the tiles are within clip slots to form an arrangement of tiles; and securing the arrangement of tiles to the structure by attaching the clip body of at least one clip of the plurality of clips to the structure.

2. The method of claim 1, wherein the attaching the clip body of the at least one clip to the structure comprises inserting the fastener through the clip aperture of the clip and the clip body of the at least one clip and inserting the fastener into the structure.

3. The method of claim 1, wherein each hanger of the plurality of hangers comprises a plurality of score lines.

4. The method of claim 3, further comprising breaking a hanger along a score line to remove a clip of the plurality of clips from the hanger.

5. The method of claim 1, wherein each tile of the plurality of tiles comprises four tile apertures.

6. An arrangement of tiles, comprising:

a hanger comprising a hanger body and a plurality of clips attached to the hanger body, wherein each clip of the plurality of clips comprises a clip body configured for an attachment to a structure; and a plurality of tiles, wherein each tile of the plurality of tiles comprises a tile aperture;

wherein each clip body of each clip comprises:

a clip prong with a clip prong body and a clip prong tip that extends from the clip prong body toward a hanger midline to form a clip slot; and a clip aperture that extends through the clip and the clip body, wherein the clip aperture is configured to accept a fastener therethrough for the attachment to the structure;

wherein at least one clip prong tip of at least one clip prong is removably accepted by at least one tile aperture to secure at least one portion of at least one tile of the plurality of tiles within at least one clip slot and to at least one hanger.

7. The arrangement of tiles of claim 6, wherein the clip body has a circular cross section and a clip body diameter, and wherein the tile aperture has a circular cross section and a tile aperture diameter, wherein the clip body diameter and the tile aperture diameter are approximately equal.

8. The arrangement of tiles of claim 6, wherein the clip prongs extend from the clip body toward a hanger body center point of the hanger body.

9. The arrangement of tiles of claim 6, wherein the plurality of clips includes four clips.

10. The arrangement of tiles of claim 6, wherein the hanger comprises a plurality of score lines.

11. The arrangement of tiles of claim 10, wherein breakage of the hanger along at least one score line results in removal of at least one clip of the plurality of clips from the hanger.

12. A hanger comprising:

a hanger body comprising a front surface and a back surface opposed from the front surface;

a plurality of clips attached to the front surface of the hanger body, wherein each clip of the plurality of clips comprises:

a clip body configured for attachment to a structure, wherein the clip body comprises a clip aperture that extends through the clip body; and a clip prong that extends from the clip body to form a clip prong slot; and a plurality of score lines formed along the back surface of the hanger body to facilitate breakage of the hanger body, wherein breakage along at least one score line results in removal of at least one clip of the plurality of clips from the hanger body.

13. The hanger of claim 12, wherein the clip prong extends from the clip body at a clip prong angle relative to the hanger body, wherein the clip prong angle is greater than zero.

14. The hanger of claim 12, wherein the clip prong extends from the clip body at a clip prong angle relative to the hanger body, wherein the clip prong angle is greater than zero.

15. A kit comprising the hanger of claim 12 and further comprising a plurality of tiles, wherein a first tile of the plurality of tiles is removably couplable to the hanger by insertion of a first clip prong of a first clip of the plurality of clips through a tile aperture of the first tile such that a portion of the first tile is within a first clip slot of the first clip prong, and wherein a second tile of the plurality of tiles is removably couplable to the hanger by insertion of a second clip prong of a second clip of the plurality of clips through a tile aperture of the second tile such that a portion of the second tile is within a second clip slot of the second clip prong.

* * * * *